US009907367B2

(12) United States Patent
Paik et al.

(10) Patent No.: US 9,907,367 B2
(45) Date of Patent: Mar. 6, 2018

(54) BUCKLE

(71) Applicant: WOOJIN PLASTIC CO., LTD, Guri-si, Gyeonggi-do (KR)

(72) Inventors: Jisook Paik, Seoul (KR); Nan Hee Paik, Seoul (KR); Ji Hye Paik, Seoul (KR); Ji Won Son, Seoul (KR)

(73) Assignee: WOOJIN PLASTIC CO., LTD, Guri-si (KR)

( * ) Notice: Subject to any disclaimer, the term of this patent is extended or adjusted under 35 U.S.C. 154(b) by 0 days.

(21) Appl. No.: 15/299,011

(22) Filed: Oct. 20, 2016

(65) Prior Publication Data

US 2017/0127767 A1 May 11, 2017

(30) Foreign Application Priority Data

Nov. 5, 2015 (KR) ..... 10-2015-0154895

(51) Int. Cl.

| | |
|---|---|
| ***A44B 11/25*** | (2006.01) |
| ***A41F 1/00*** | (2006.01) |
| ***A45C 13/10*** | (2006.01) |
| ***A44B 11/00*** | (2006.01) |
| ***A45F 3/04*** | (2006.01) |
| ***A45F 5/02*** | (2006.01) |
| *A45F 3/00* | (2006.01) |

(52) U.S. Cl.

CPC ..... *A44B 11/2588* (2013.01); *A41F 1/002* (2013.01); *A44B 11/005* (2013.01); *A45C 13/1069* (2013.01); *A45C 13/1076* (2013.01); *A45F 3/04* (2013.01); *A45F 5/021* (2013.01); *A44D 2203/00* (2013.01); *A45F 2003/001* (2013.01); *A45F 2003/003* (2013.01); *A45F 2003/045* (2013.01); *Y10T 24/32* (2015.01)

(58) Field of Classification Search

CPC ..... Y10T 24/32; A41F 1/002

See application file for complete search history.

(56) References Cited

U.S. PATENT DOCUMENTS

| | | | | |
|---|---|---|---|---|
| 3,376,616 A * | 4/1968 | Kaczorowski | A44B 11/258 | 24/303 |
| 5,664,298 A * | 9/1997 | Nessar-Ivanovic | A44C 5/2071 | 24/303 |
| 7,496,994 B1 * | 3/2009 | Headley | A44C 5/2019 | 24/303 |
| 2004/0107547 A1 * | 6/2004 | Chung | A44B 11/258 | 24/303 |

(Continued)

*Primary Examiner* — Robert Sandy
*Assistant Examiner* — Michael S Lee
(74) *Attorney, Agent, or Firm* — Novick, Kim & Lee, PLLC; Jae Youn Kim

(57) ABSTRACT

Provided is a buckle including a plug member and a socket member. The plug member includes a plate extending forward from a lower end of a base and having a first magnet embedded in a middle portion thereof, and a holder protruding from a front end of the plate. The socket member includes an upper plate extending forward from an upper end of a base and having a second magnet embedded in a middle portion thereof, side plates formed on opposite sides of the upper plate, and a accommodation region formed inside the upper plate and the side plates so as to accommodate the plate therein. The upper plate has a holder aperture formed therein so that the holder is seated in the holder aperture when the plug member and the socket member are coupled to each other.

13 Claims, 10 Drawing Sheets

(56) References Cited

U.S. PATENT DOCUMENTS

| | | | | |
|---|---|---|---|---|
| 2014/0317890 | A1* | 10/2014 | Koons | A42B 3/08 24/303 |
| 2015/0135486 | A1* | 5/2015 | Fiedler | A44B 11/2584 24/303 |
| 2017/0127768 | A1* | 5/2017 | Paik | A44B 11/266 |
| 2017/0172262 | A1* | 6/2017 | Paik | A44B 11/2592 |

* cited by examiner

BUCKLE

CROSS-REFERENCE TO RELATED APPLICATION

This application claims the priority to Korean patent application No. 10-2015-0154895 filed on Nov. 5, 2015, the disclosure of which is incorporated by reference in its entirety.

BACKGROUND OF THE INVENTION

Field of the Invention

The present invention relates to a buckle, and more particularly, to a buckle, which includes a socket member and a plug member separably coupled to each other, each of the socket member and the plug member being mounted on an end of a belt or strap attached to any of various articles, such as, for example, an article of clothing, a bag, a knapsack, or a helmet.

Description of the Related Art

Generally, a buckle is a fastening device in which two members are coupled and fixed to each other as described above. Such a buckle is manufactured by integrally molding these constituent members from a plastic material so as to implement elastic coupling therebetween, and thus has widely been used because it is light and is easily fastened.

FIG. 1 is a schematic perspective view illustrating an example of a conventional buckle. The conventional buckle includes a plug member 10 and a socket member 20.

As illustrated in FIG. 1, the plug member 10 includes a pair of lock arms 12, which protrude in a straight line from a base 11 of a body and have elasticity. A fastening portion protrudes outward from the front end of each lock arm 12. The plug member 10 further includes a guide rod 13, which is located between the lock arms 12 and extends a long length in a straight line from the base 11. The socket member 20 defines a chamber 21, which is open from the front end of the socket member 20 so as to accommodate the plug member 10 therein. The socket member 20 is provided in opposite sidewalls thereof with a pair of holes 22 so that the respective lock arms 12 are elastically coupled in the holes 22.

When a user inserts the plug member 10 from the open front end of the socket member 20 through the chamber 21, the lock arms 12 formed on opposite sides of the plug member 10 are elastically bent inward as the outer side surfaces thereof slide along the inner sidewalls of the socket member 20. Then, the lock arms 12 are elastically returned outward when the ends thereof are located in the respective holes 22, thereby being seated in and fastened into the holes 22.

Thereafter, when attempting to unfasten the buckle, the user may apply pressure from opposite outer sides to the lock arms 12 of the plug member 10, which are exposed from the holes 22 in the socket member 20, so that the respective lock arms 12 are separated from the holes 22 in the socket member 20. When the user pulls the plug member 10 outward simultaneously with the separation of the lock arms 12, the plug member 10 and the socket member 20 are separated from each other.

The conventional buckle, however, requires high technical skill for the manufacture thereof because of a complicated configuration, i.e. because the pair of lock arms having a complicated configuration are provided and because the chamber in the socket member, which is required in order to accommodate the lock arms, and a coupling structure inside the chamber for fastening the lock arms have a complicated configuration.

In addition, in the conventional buckle, the connection of the plug member and the socket member requires the user to grip the plug member and the socket member with both hands so as to insert one into the other. In the same manner, the separation of the plug member and the socket member requires the user to grip the plug member and the socket member with both hands so as to push and separate the lock arms of the plug member. As described above, the conventional buckle may be fastened only when the user accurately couples the plug member and the socket member to each other using both hands.

Because the user needs to use both hands to fasten the buckle, the user cannot perform any other motion with the hands even if the user needs to manipulate, for example, a belt or strap installed on, for example, a knapsack that the user wears when performing an activity, such as climbing, trekking or the like. Also, the user needs to put down any article being held in the hands in order to fasten the buckle. Due to this troublesome manipulation, there is a demand for a buckle that enables more simplified fastening manipulation with one hand.

SUMMARY OF THE INVENTION

Therefore, the present invention has been made in view of the above problems of the related art, and it is one object of the present invention to provide a buckle for use in various belts, straps and the like, in which a plug member and a socket member may have a very simplified configuration and may be simply coupled to each other.

It is another object of the present invention to provide a buckle in which coupling between a plug member and a socket member is implemented even when they are simply brought close to each other, which enables convenient connection between the plug member and the socket member using only one hand.

It is a further object of the present invention to provide a buckle, to which various functional elements, such as an elevating buckle, a loop of a water supply hose, a whistle, a strap-fixing piece, and a ring, may be additionally coupled, which enables utilization of the buckle across various fields.

In accordance with an aspect of the present invention, the above and other objects can be accomplished by the provision of a buckle including a plug member including a plate extending forward from a lower end of a base and having a first magnet embedded in a middle portion thereof, and a holder protruding from a front end of the plate, and a socket member including an upper plate extending forward from an upper end of a base and having a second magnet embedded in a middle portion thereof, side plates formed on opposite sides of the upper plate, and an accommodation region formed inside the upper plate and the side plates so as to accommodate the plate therein, the upper plate having a holder aperture formed therein so that the holder is seated in the holder aperture when the plug member and the socket member are coupled to each other, wherein the plug member and the socket member are separably connected to each other.

The upper end of the base of the socket member may be formed lower than an upper surface of the upper plate.

The first magnet of the plate and the second magnet of the upper plate may be attached to face each other at coincident positions when the plug member and the socket member are coupled to each other.

According to another feature of the present invention, the plug member may have a first slot formed in a contact portion of the base and the plate, and the socket member may have a holding protrusion protruding from a front end of the upper plate so as to correspond to and be fitted into the first slot.

Here, the holding protrusion may have a curved or inclined lower surface.

According to another feature of the present invention, the plug member may have a second slot formed in a contact portion of the plate and the holder, and the socket member may have a guide protrusion protruding from a rear end of the upper plate so as to correspond to and be fitted into the second slot.

The second slot may have an inclined inner corner, and the guide protrusion may have an inclined outer corner, which corresponds to the inclined inner corner of the second slot.

According to another feature of the present invention, each of the plug member and the socket member may include a crossbar and a strap-hooking bar, which are selectively formed at a rear side of the base.

According to another feature of the present invention, the plug member or the socket member may include an elevating rail holder provided on a rear end thereof.

According to another feature of the present invention, the plug member or the socket member may include a loop provided on a rear end thereof so as to hold and fix a hose connected to a water bottle.

According to another feature of the present invention, the plug member or the socket member may have a rear end configured to enable connection of a whistle.

According to another feature of the present invention, the plug member or the socket member may include a strap connector provided on a rear end thereof.

According to a further feature of the present invention, the plug member or the socket member may include a ring provided on a rear end thereof to enable connection of any of various loops.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
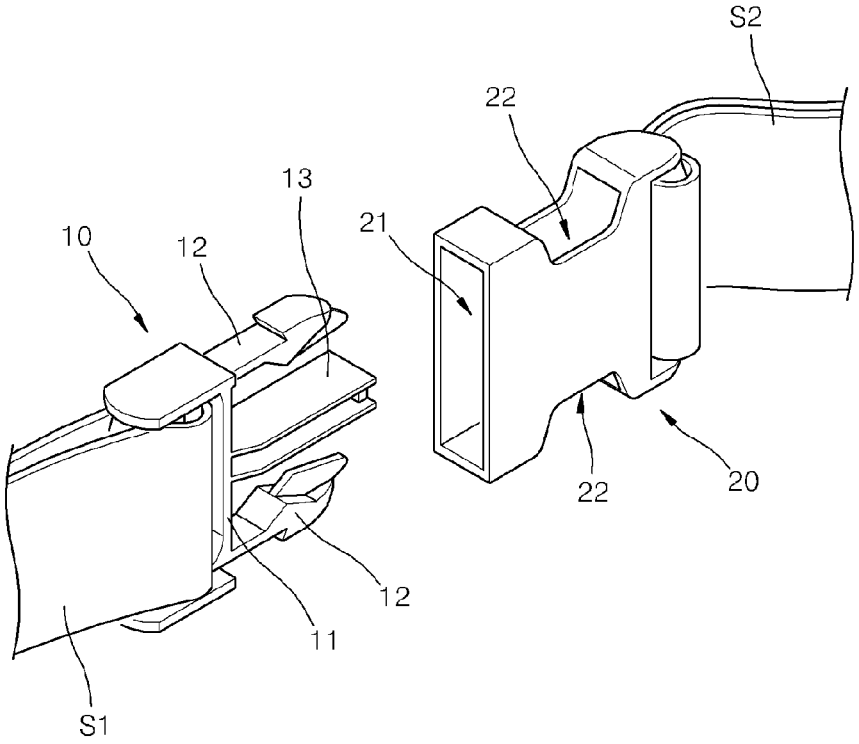
PRIOR ART FIG. 1
FIG. 1 is a perspective view illustrating an example of a conventional buckle.
Figure 2:
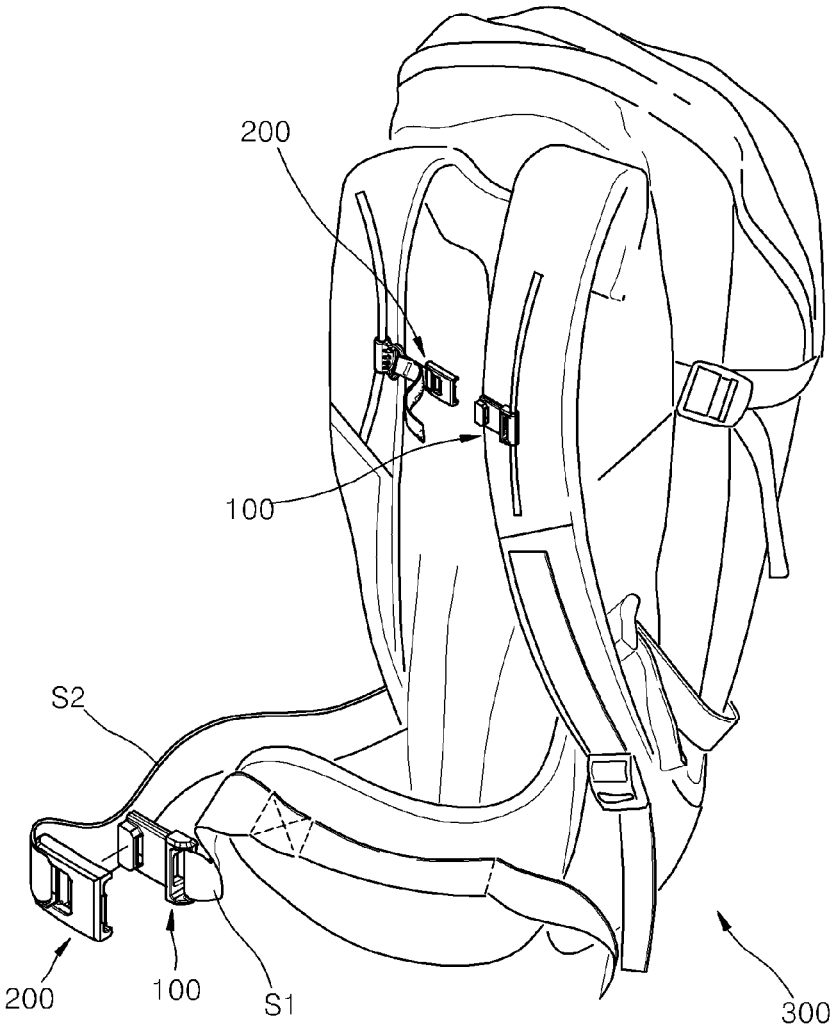
FIG. 2 is a view illustrating an embodiment in which the present invention is applied to a knapsack.
Figure 3:
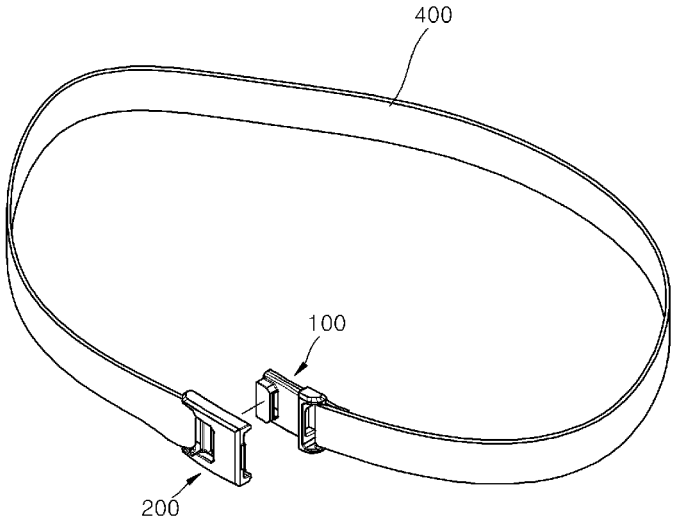
FIG. 3 is a view illustrating an embodiment in which the present invention is applied to a belt.
Figure 4:
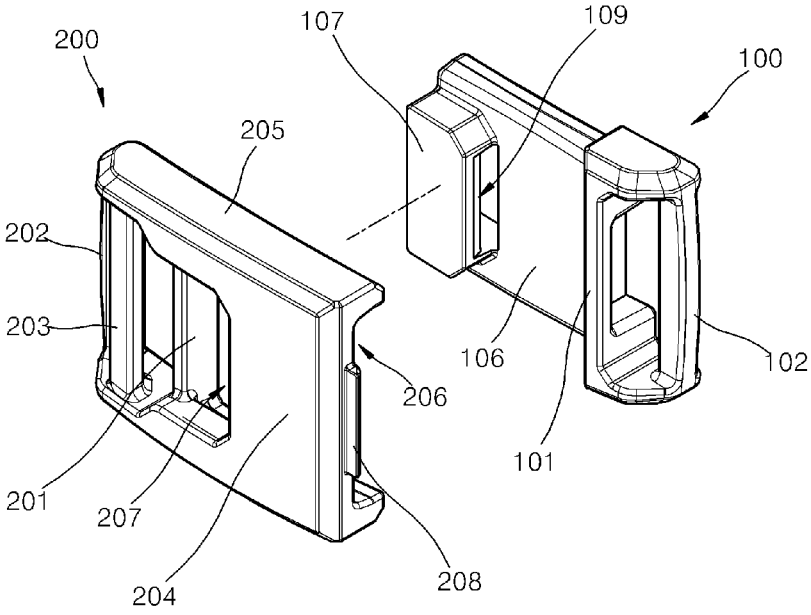
FIG. 4 is an exploded perspective view illustrating an example of a buckle according to the present invention.
Figure 5:
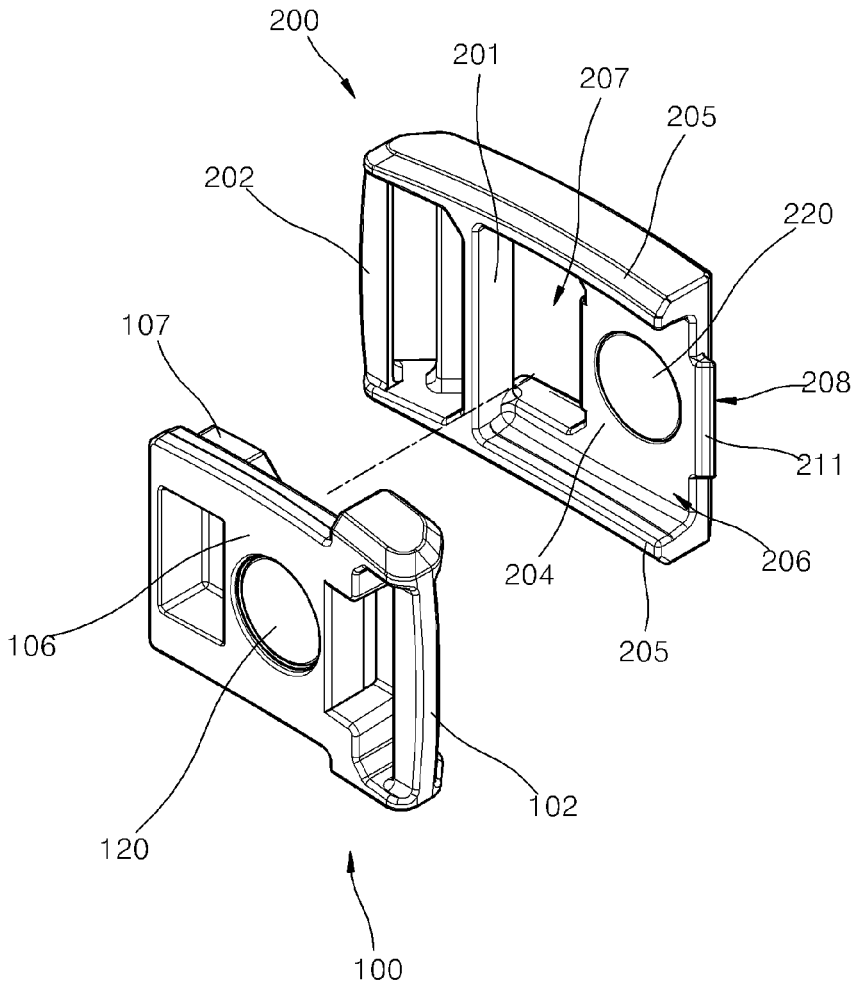
FIG. 5 is a bottom exploded perspective view of the buckle according to the present invention.
Figure 6:
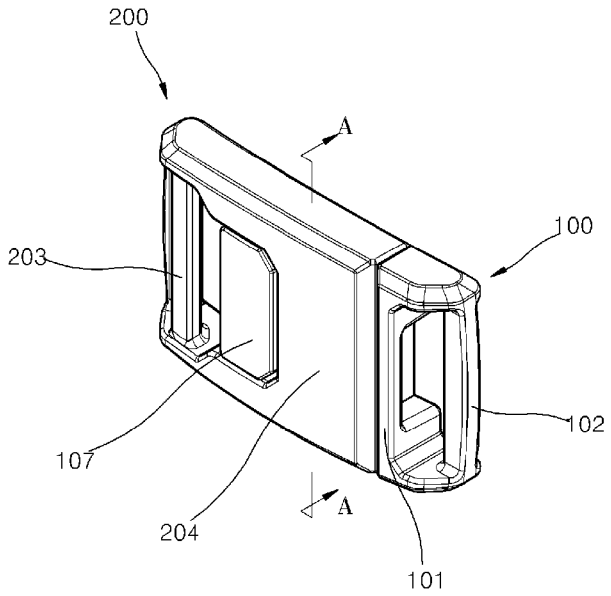
FIG. 6 is a perspective view illustrating the coupled state of the buckle according to the present invention.
Figure 7:
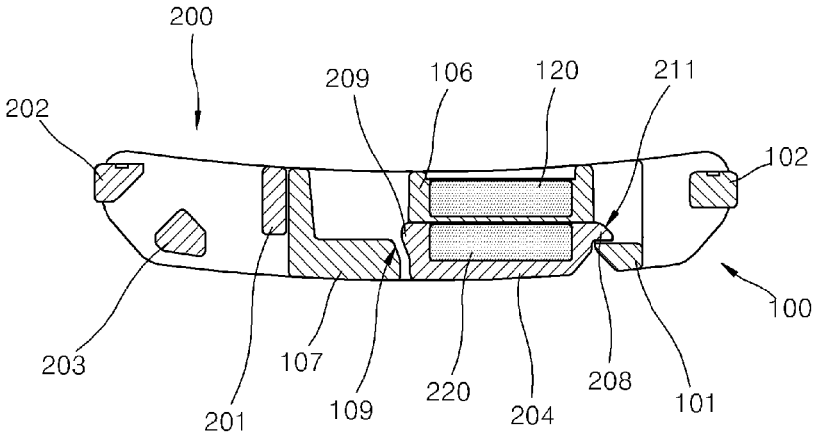
FIG. 7 is a sectional view taken along line A-A of FIG. 6.

FIG. 2 is a view illustrating an embodiment in which the present invention is applied to a knapsack, FIG. 3 is a view illustrating an embodiment in which the present invention is applied to a belt, FIG. 4 is an exploded perspective view illustrating an example of a buckle according to the present invention, FIG. 5 is a bottom exploded perspective view of the buckle according to the present invention, FIG. 6 is a perspective view illustrating the coupled state of the buckle according to the present invention, and FIG. 7 is a sectional view taken along line A-A of FIG. 6.

Referring to FIGS. 2 to 7, the buckle according to the present invention broadly includes a plug member 100 and a socket member 200, which are separably coupled to each other. Both members are generally molded using a synthetic resin, and are used by being connected to straps S1 and S2 or a belt 400 of, for example, a knapsack 300, as illustrated in FIGS. 2 and 3, which are views illustrating the buckle in use.

The plug member 100 includes a base 101, and a crossbar 102, which is located at the rear side of the base 101 and extends in the transverse direction of the plug member 100 so that a free end of the strap S1 is caught and fixed by the crossbar 102. The strap S1 is wound around the crossbar 102 and is sewn to the crossbar 102.

A plate 106 extends forward from the base 101, and a holder 107 protrudes from the front end of the plate 106.

The upper surface of the base 101 and the upper surface of the holder 107 may be located at the same height. A portion between the base 101 and the holder 107, which are spaced apart from each other, corresponds to the upper surface of the plate 106, to which the socket member 200 is coupled.

A first magnet 120 is embedded in the lower surface of the plate 106 at a position corresponding to the middle of the plate 106, i.e. at a middle position between the base 101 and the holder 107.

A first slot 108 is formed in a corner portion of the plug member 100 at which the base 101 and the plate 106 come into contact with each other, and a second slot 109 is formed in a corner portion of the plug member 100 at which the plate 106 and the holder 107 come into contact with each other.

The socket member 200 includes a base 201, an upper plate 204 extending forward from the base 201, and sidewalls 205 formed on opposite sides of the upper plate 204, thereby defining an accommodation region 206 in order to guide and accommodate the plug member 100 therein. The socket member 200 further includes a crossbar 202 and a strap-hooking bar 203, which are located side by side at the rear side of the base 201 and extend in the transverse direction of the socket member 200 so as to fix a free end of the strap S2. The strap S2 is alternately wound around the crossbar 202 and the strap-hooking bar 203 in order to enable adjustment in the length of the strap S2.

Alternatively, only the crossbar 202 may be provided, in which case the free end of the strap S2 is wound around the crossbar 202 and is sewn to the crossbar 202. In the same manner as the socket member 200, the plug member 100 may further include a strap-hooking bar in order to enable adjustment in the length of the strap S1.

The accommodation region 206 in the socket member 200 is open at the bottom side and the front side thereof, and the inner side of the accommodation region 206 is finished by the base 201. A holder aperture 207 is formed in one end of the upper plate 204, which comes into contact with the base 201, so that the holder 107 of the plug member 100 may be fitted into the holder aperture 207.

The upper plate 204 extends from a portion above the base 201, and thus the upper end of the base 201 is located lower than the upper surface of the upper plate 204 so as to be recessed from the holder aperture 207. This structure provides a space through which the user can push the holder 107 when unfastening the buckle.

Accordingly, the upper plate 204 is spaced apart from the base 201 with the holder aperture 207 interposed therebetween, and a second magnet 220 is embedded in the upper plate 204.

In addition, the upper plate 204 is provided on the front lower end thereof with a holding protrusion 208, which is configured so as to be fitted into the first slot 108 in the plug member 100. The upper plate 204 is also provided on the rear lower end thereof with a guide protrusion 209, which corresponds to the second slot 109 in the plug member 100.

To summarize the configuration described above, the plate 106 of the plug member 100 is configured so as to be accommodated in and come into close contact with the accommodation region 206 in the socket member 200, and in the state in which the plate 106 is accommodated in and comes into close contact with the accommodation region 206, the holder 107 of the plug member 100 is closely fitted into the holder aperture 207 in the socket member 200.

In addition, in the state in which the plug member 100 and the socket member 200 are coupled to each other and come into close contact with each other, the first magnet 120 and the second magnet 220 are arranged to face each other so that the positions thereof coincide with each other, the holding protrusion 208 is fitted into the first slot 108, and the guide protrusion 209 is located in the second slot 109.

The buckle according to the present invention is fastened using the magnetic force of the first magnet 120 and the second magnet 220. When the plug member 100 and the socket member 200 are brought close to each other, the plug member 100 and the socket member 200 attract each other by the magnetic force of the first magnet 120 and the second magnet 220, thereby causing the first magnet 120 and the second magnet 220 to be momentarily attached to each other. This means that the plate 106 of the plug member 100 is accommodated in and comes into close contact with the accommodation region 206, and in addition, the holder 107 is closely fitted in the holder aperture 207.

In the coupled state described above, the upper plate 204 of the socket member 200 comes into close contact with the portion between the base 101 and the holder 107 of the plug member 100, such that the upper surface of the holder 107, the upper surface of the upper plate 204, and the upper surface of the base 101 define a plane.

In addition, because the holding protrusion 208 is fitted in the first slot 108 in the state in which the plug member 100 and the socket member 200 are coupled to each other, the plug member 100 and the socket member 200 may not be separated from each other even when an attempt is made to separate them in the vertical direction with greater force than the coupling force of the first magnet 120 and the second magnet 220.

Separation between the plug member 100 and the socket member 200 may be achieved when the upper surface of the holder 107 of the plug member 100 is pushed so that the plug member 100 rotates relative to the socket member 200 about the holding protrusion 208 as the rotation axis.

In order to ensure smooth implementation of the rotation described above, the holding protrusion 208 is provided on the lower surface thereof with a slope 211. As such, the holding protrusion 208 is smoothly discharged from the first slot 108 without being caught by the entrance of the first slot 108 while rotating.

Here, the slope 211 of the holding protrusion 208 may be curved.

FIG. 7 is a sectional view illustrating the coupled state of the plug member 100 and the socket member 200. As illustrated in FIG. 7, the holding protrusion 208 is provided with the slope 211, the inner corner of the second slot 109 is inclined or curved, and the outer corner of the guide protrusion 209, which corresponds to the inclined or curved inner corner of the second slot 109, is also inclined or curved. With this configuration, when the plug member 100 rotates relative to the socket member 200 about the holding protrusion 208, no collision occurs therebetween.

In addition, in order to ensure that the upper plate 204 of the socket member 200 is smoothly coupled to or separated from the upper portion of the plate 106 of the plug member 100, the distance between the base 101 and the holder 107 of the plug member 100 is slightly greater than the width of the upper plate 204, which is coupled to the portion between the base 101 and the holder 107.

The action of the buckle according to the present invention having the configuration described above will be described below.

First, when one member, among the plug member 100 and the socket member 200, is brought close to the other member in order to couple the plug member 100 and the socket member 200 to each other, the plug member 100 and the socket member 200 attract each other by the magnetic force of the first magnet 120 and the second magnet 220, thereby causing the first magnet 120 and the second magnet 220 to be momentarily attached to each other. Thereby, as illustrated in FIG. 8(A), the plug member 100 and the socket member 200 are coupled to and come into close contact with each other.

Thereby, the plate 106 of the plug member 100 is accommodated in and comes into close contact with the accommodation region 206 in the socket member 200, and the holder 107 is closely fitted in the holder aperture 207. This is accomplished as the plug member 100 and the socket member 200 are automatically coupled to each other by momentary attachment force attributable to the strong magnetic force of the magnets 120 and 220. In the course of the momentary coupling, the holding protrusion 208 is inserted into and seated in the first slot 108.

When the plug member 100 and the socket member 200 are simply pulled or vertically lifted while in the coupled state described above, the plug member 100 and the socket member 200 are not separated from each other owing to the coupling relationship of the holding protrusion 208.

Figure 8:
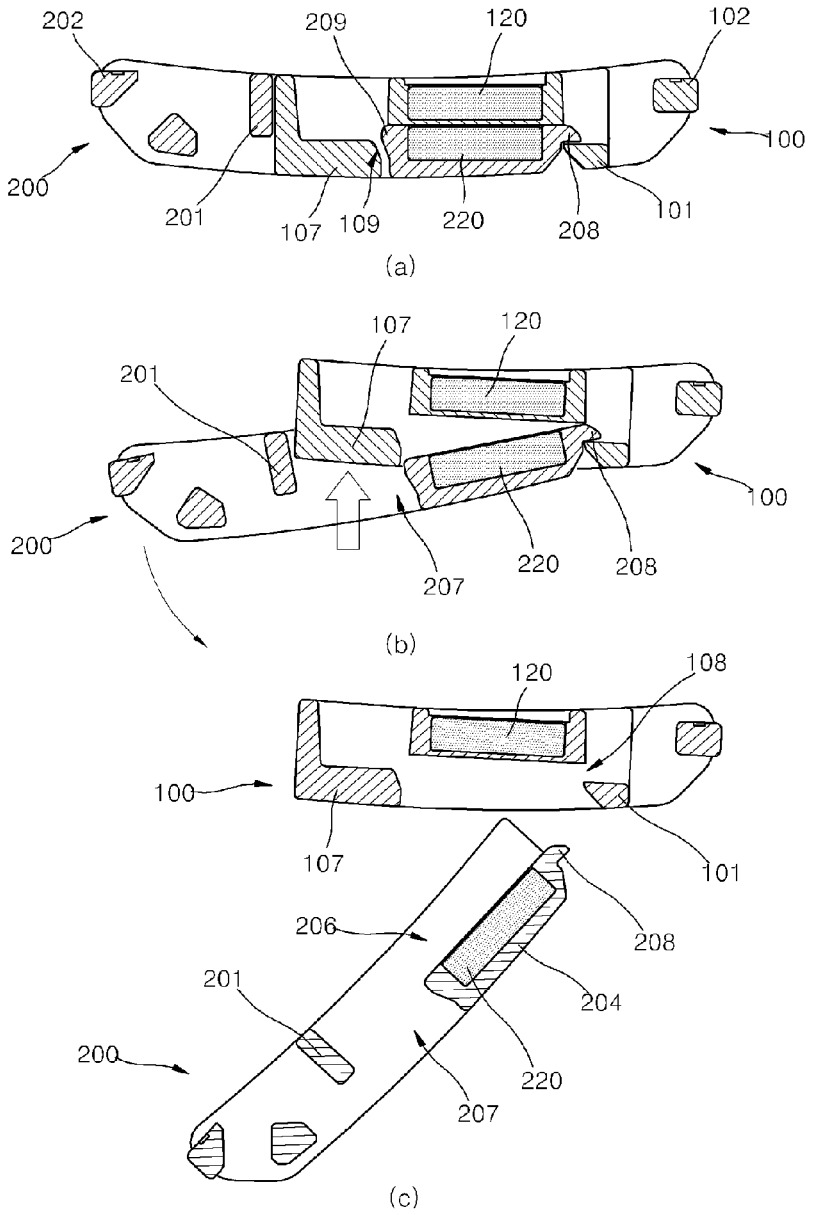
FIG. 8 is a view illustrating the coupling sequence of a plug member and a socket member according to the present invention.

In order to separate the plug member 100 from the socket member 200, as illustrated in FIG. 8(B), pressure is applied to the exposed upper surface of the holder 107 so as to rotate the plug member 100 or the socket member 200 about the holding protrusion 208. Through this rotation, the guide protrusion 209 and the second slot 109 come into contact with each other at the inclined portions thereof and are then gradually separated from each other, thus causing the first magnet 120 and the second magnet 220 to be separated from each other. As the guide protrusion 209 is completely separated from the second slot 109, as illustrated in FIG. 8(C), the plug member 100 and the socket member 200 are separated from each other.

Here, because the upper end of the base 201 is located lower than the upper surface of the holder 107, the sufficient space to freely push the holder 107 is provided.

Because the plug member 100 and the socket member 200 may be momentarily coupled to each other by the magnets 120 and 220, even while the coupling between the plug member 100 and the socket member 200 is being implemented with one hand, an operation of coupling and separating, for example, a belt or a strap may be performed with the other hand in some cases. The ability to perform different operations at the same time with respective hands is very advantageous.

For example, in a situation, such as, for example, performing any of various tasks or climbing, one hand may often be used to grip or hold something. In this situation, it may be difficult to couple or release a buckle using two hands.

Accordingly, the buckle may be coupled or released with only one hand in the situation mentioned above, which may provide excellent convenience.

Figure 9:
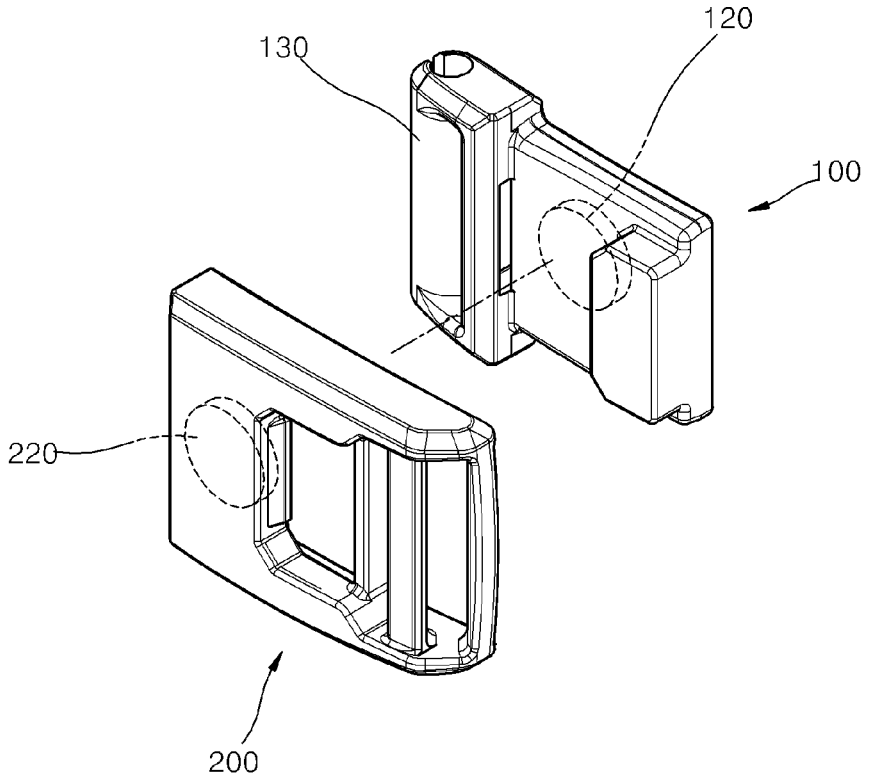
FIGS. 9 to 12 are exploded perspective views illustrating other embodiments of the present invention.

FIGS. 9 to 12 illustrate other embodiments of the present invention. FIG. 9 illustrates an embodiment in which, instead of the crossbar, an elevating rail holder 130 is provided on the rear end of the plug member 100, which is coupled to the socket member 200. As such, the buckle may be applied as an elevating buckle, which is installed to, for example, a shoulder strap of a knapsack. The elevating rail holder 130 may be installed on the rear end of the socket member 200.

Because the elevating buckle is installed to, for example, the shoulder strap of the knapsack so as to vertically move, even in this case, the plug member 100 and the socket member 200 may be respectively provided with the first magnet 120 and the second magnet 220, thereby being simply connected to each other by magnetic force when they are simply brought close to each other.

Figure 10:
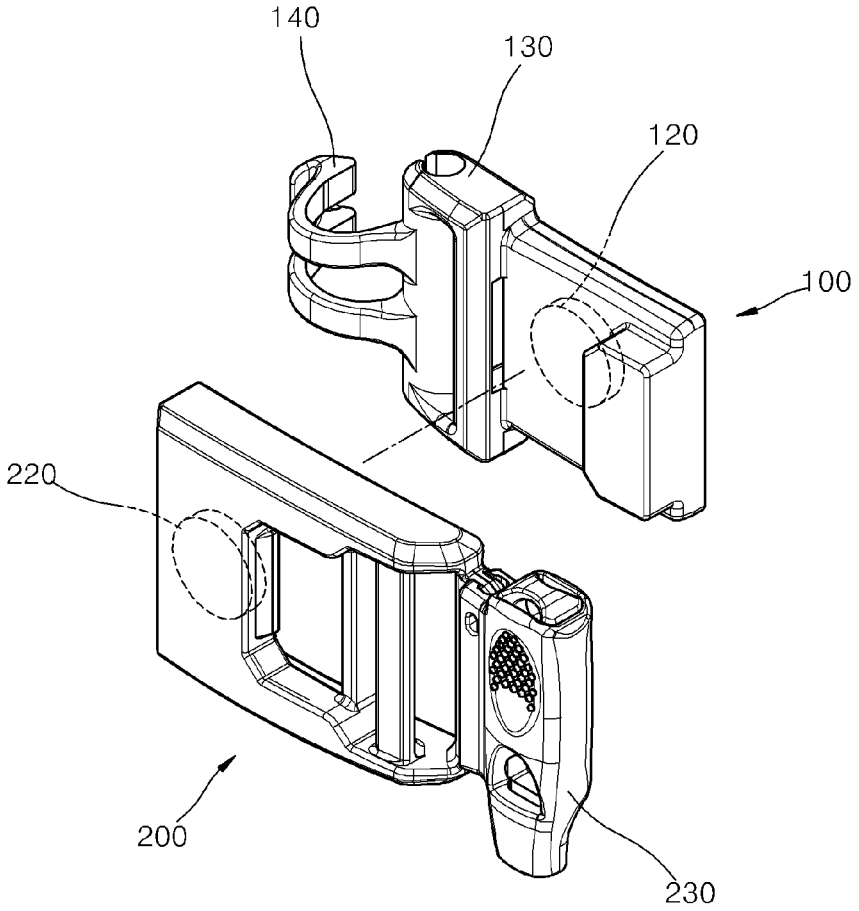

FIG. 10 illustrates an embodiment in which, in addition to FIG. 9, a loop 140 may be formed on one end of the elevating rail holder 130, which is formed on the rear end of the plug member 100. As such, a water supply hose, which is connected to a water bottle, may be connected and fixed to an elevating buckle, which is located on the chest region of the knapsack. In addition, a whistle 230 may be fitted to the crossbar of the socket member 200 so as to be carried along with the buckle.

When the user who wears a knapsack goes climbing or trekking, the user may carry a water bottle in the knapsack and may try to drink water through a hose of the water bottle without taking off the knapsack. In this case, the hose may be held and fixed on the loop 140, which ensures the convenient use of the hose.

In addition, when the whistle 230 is carried by being connected to the rear end of the socket member 200 according to the present invention, the whistle 230 may be simply used in an emergency situation.

When the loop 140 or the whistle 230 is applied to the plug member 100 and the socket member 200, which may be easily coupled to or separated from each other by the magnets 120 and 220, various additional functions may be applied to the buckle.

Figure 11:
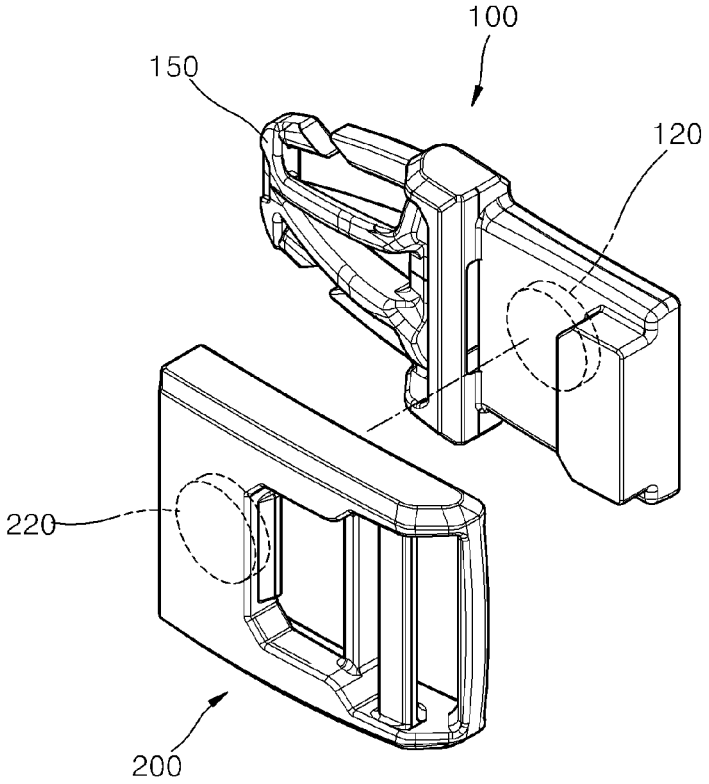

FIG. 11 illustrates an embodiment in which a strap connector 150 is provided on the crossbar of the plug member 100, which is coupled to the socket member 200, so that the plug member 100 may be movably installed on a strap.

A strap installed on, for example, a knapsack or a bag may be fitted into the strap connector 150 so that the buckle is movable on the strap so as to be adjustable in position. In the state in which the buckle is mounted on the strap, the plug member 100 and the socket member 200 may be conveniently coupled or separated to or from each other using the magnets 120 and 220.

Figure 12:
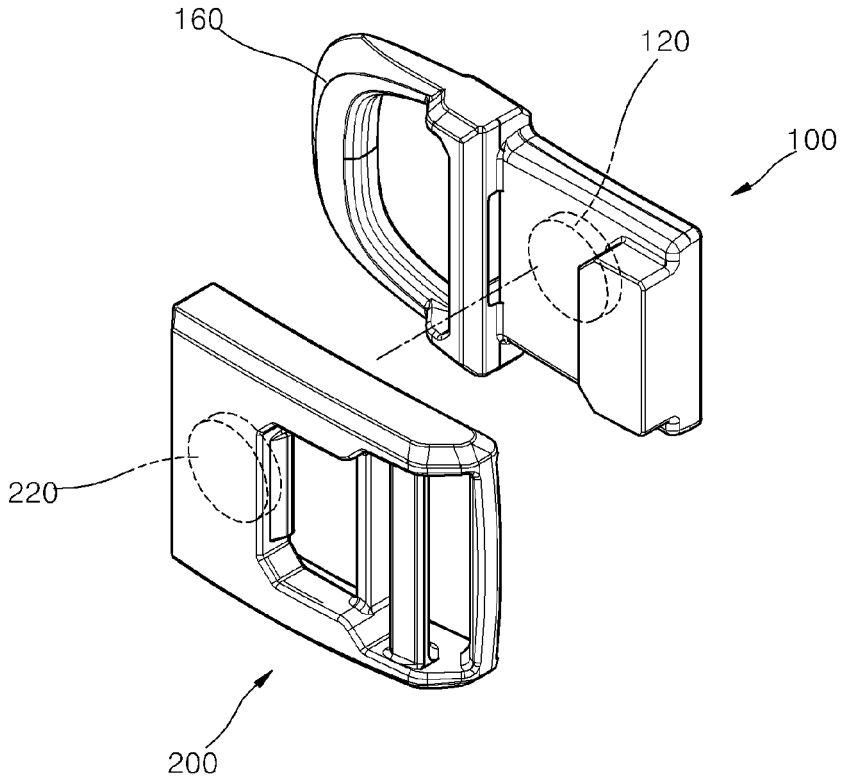

FIG. 12 illustrates an embodiment in which, instead of the crossbar, a ring 160 may be provided on the rear end of the plug member 100, which is coupled to the socket member 200. Any of various small articles may be carried by being held on the ring 160, or a loop, which is installed on, for example, a suspender or a strap, may be connected to the ring 160.

That is, when the ring 160 is provided on the socket member 200 and the plug member 100, which are provided with the magnets 120 and 220, any of various loops or small articles may be held on the ring 160. Thereby, the ring 160 may provide the buckle with various functionalities.

As is apparent from the above description, in a configuration in which a plug member and a socket member are coupled to each other according to the present invention, the plug member and the socket member may be coupled to each other using magnets without lock arms for fastening therebetween, which may result in a simplified configuration, increased productivity, and reduced manufacturing costs.

According to the present invention, the plug member and the socket member are respectively provided with magnets, which correspond to each other, so as to be coupled to each other via strong magnetic attraction therebetween even when they are simply brought close to each other. Thereby, the coupling may be conveniently achieved with only one hand. In addition, the coupled state of the plug member and the socket member may be stably maintained by, for example, a slot and a holding protrusion formed on the plug member and the socket member so as to correspond to each other.

In addition, various functional elements, such as an elevating buckle, a loop for a water supply hose, a whistle, a strap-fixing piece, and a ring, may be additionally coupled to the buckle according to the present invention.

What is claimed is:

1. A buckle comprising:

a plug member including a plate extending forward from a lower end of a base and having a first magnet embedded in a middle portion thereof, and a holder protruding from a front end of the plate; and a socket member including an upper plate extending forward from an upper end of a base and having a second magnet embedded in a middle portion thereof, side plates disposed on opposite sides of the upper plate, and an accommodation region disposed inside the upper plate and the side plates so as to accommodate the plate therein, the upper plate having a holder aperture disposed therein so that the holder is seated in the holder aperture when the plug member and the socket member are coupled to each other, wherein the plug member and the socket member are separably connected to each other and wherein the plug member has a slot disposed in a contact portion of the plate and the holder, and the socket member has a guide protrusion protruding from a rear end of the upper plate so as to correspond to and be fitted into the slot.

2. The buckle according to claim 1, wherein the upper end of the base of the socket member is disposed lower than an upper surface of the upper plate.

3. The buckle according to claim 1, wherein the first magnet of the plate and the second magnet of the upper plate are attached to face each other at coincident positions when the plug member and the socket member are coupled to each other.

4. The buckle according to claim 1, wherein the plug member has another slot disposed in a contact portion of the base and the plate, and the socket member has a holding protrusion protruding from a front end of the upper plate so as to correspond to and be fitted into the another slot.

5. The buckle according to claim 4, wherein the holding protrusion has a curved or inclined lower surface.

6. The buckle according to claim 1, wherein the slot has an inclined inner corner, and the guide protrusion has an inclined outer corner, which corresponds to the inclined inner corner of the slot.

7. The buckle according to claim 1, wherein each of the plug member and the socket member includes a crossbar and a strap-hooking bar, which are selectively disposed at a rear side of each of the bases of the plug member and the socket member.

8. The buckle according to claim 1, wherein the plug member or the socket member includes an elevating rail holder disposed on a rear end thereof.

9. The buckle according to claim 1, wherein the plug member or the socket member includes a loop disposed on a rear end thereof so as to hold and fix a hose connected to a water bottle.

10. The buckle according to claim 1, wherein the plug member or the socket member has a rear end configured to enable connection of a whistle.

11. The buckle according to claim 1, wherein the plug member or the socket member includes a strap connector disposed on a rear end thereof.

12. A buckle comprising:

a plug member including a plate extending forward from a lower end of a base and having a first magnet embedded in a middle portion thereof, and a holder protruding from a front end of the plate; and a socket member including an upper plate extending forward from an upper end of a base and having a second magnet embedded in a middle portion thereof, side plates disposed on opposite sides of the upper plate, and an accommodation region disposed inside the upper plate and the side plates so as to accommodate the plate therein, the upper plate having a holder aperture disposed therein so that the holder is seated in the holder aperture when the plug member and the socket member are coupled to each other, wherein the plug member and the socket member are separably connected to each other, and wherein the plug member has a first slot and a second slot, which are respectively formed in a contact portion of the base and the plate and in a contact portion of the plate and the holder, and the socket member has a holding protrusion and a guide protrusion, which protrude respectively from a front end and a rear end of the upper plate so as to correspond to and be fitted into the first slot and the second slot respectively.

13. The buckle according to claim 12, wherein the holding protrusion has a curved or inclined lower surface, the second slot has an inclined inner corner, and the guide protrusion has an inclined outer corner, which corresponds to the inclined inner corner of the second slot.

* * * * *